US009501975B2

(12) United States Patent
Eom et al.

(10) Patent No.: US 9,501,975 B2
(45) **Date of Patent: *Nov. 22, 2016**

(54) ORGANIC LIGHT EMITTING DISPLAY DEVICE AND DRIVING METHOD THEREOF

(71) Applicant: Samsung Electronics Co., Ltd., Gyeonggi-do (KR)

(72) Inventors: Sang-Yong Eom, Gyeonggi-do (KR); Dong-Sub Kim, Gyeonggi-do (KR); Joon-Gyu Lee, Gyeonggi-do (KR)

(73) Assignee: Samsung Electronics Co., Ltd., Yeongtong-gu, Suwon-si, Gyeonggi-do (KR)

( * ) Notice: Subject to any disclaimer, the term of this patent is extended or adjusted under 35 U.S.C. 154(b) by 0 days.

This patent is subject to a terminal disclaimer.

(21) Appl. No.: 15/047,788

(22) Filed: Feb. 19, 2016

(65) Prior Publication Data

US 2016/0171932 A1 Jun. 16, 2016

Related U.S. Application Data

(63) Continuation of application No. 13/886,481, filed on May 3, 2013, now Pat. No. 9,269,294.

(30) Foreign Application Priority Data

Jun. 4, 2012 (KR) ..... 10-2012-0060061

(51) Int. Cl.
*G09G 3/32* (2016.01)

(52) U.S. Cl.
CPC ..... *G09G 3/3233* (2013.01); *G09G 3/3208* (2013.01); *G09G 2310/061* (2013.01); *G09G 2320/0626* (2013.01)

(58) Field of Classification Search
CPC ..... G09G 3/3208; G09G 2320/0233; G09G 2320/0626; G09G 2320/0666; G09G 2320/0673; G09G 2310/061; G09G 3/3233
See application file for complete search history.

(56) References Cited

U.S. PATENT DOCUMENTS

2011/0025665 A1* 2/2011 Bae ..... G09G 3/3208 345/211
2011/0122164 A1* 5/2011 Kimura ..... G09G 3/32 345/690
2011/0216056 A1* 9/2011 Yoo ..... G09G 3/32 345/212

FOREIGN PATENT DOCUMENTS

WO 2011/117684 A1 9/2011

* cited by examiner

*Primary Examiner* — Latanya Bibbins
(74) *Attorney, Agent, or Firm* — Cha & Reiter, LLC

(57) ABSTRACT

A driving method of an organic light emitting display device includes: classifying a plurality of luminance steps into at least a low luminance section and a high luminance section; and setting a reference luminance at a predefined level during the low luminance section and adjusting an off duty according to predetermined criteria for each step in the low luminance section.

11 Claims, 7 Drawing Sheets

| CLASSIFICATION | LUMINANCE (BRIGHTNESS) STEP | REFERENCE LUMINANCE | DUTY RATIO (Off duty) |
|---|---|---|---|
| SMART DIMMING SECTION | 300 | 300 | 0% |
| | 290 | 290 | 0% |
| | 280 | 280 | 0% |
| | 270 | 270 | 0% |
| | 260 | 260 | 0% |
| | 250 | 250 | 0% |
| | 240 | 240 | 0% |
| | 230 | 230 | 0% |
| | 220 | 220 | 0% |
| | 210 | 210 | 0% |
| | 200 | 200 | 0% |
| | 190 | 190 | 0% |
| AID FIXING SECTION | 180 | 273 | 40% |
| | 170 | 258 | 40% |
| | 160 | 244 | 40% |
| | 150 | 229 | 40% |
| | 140 | 215 | 40% |
| | 130 | 200 | 40% |
| | 120 | 186 | 40% |
| | 110 | 110 | 0% |
| AID DIMMING SECTION | 100 | 110 | 11.1% |
| | 90 | 110 | 21.0% |
| | 80 | 110 | 30.9% |
| | 70 | 110 | 40.1% |
| | 60 | 110 | 49.4% |
| | 50 | 110 | 58.0% |
| | 40 | 110 | 66.7% |
| | 30 | 110 | 75.3% |
| | 20 | 110 | 84.0% |

[DIVISION OF BRIGHT STEP]

| LUMINANCE (BRIGHTNESS) STEP | REFERENCE LUMINANCE | Off duty |
|---|---|---|
| 190 | - | 0% |
| 188 | 201 | 8% |
| 186 | 214 | 16% |
| 184 | 234 | 24% |
| 182 | 250 | 32% |
| 180 | 273 | 40% |

FIG.7A

ORGANIC LIGHT EMITTING DISPLAY DEVICE AND DRIVING METHOD THEREOF

CROSS REFERENCE TO RELATED APPLICATIONS

This is a Continuation application of U.S. patent application Ser. No. 13/886,481 filed on May 3, 2013 which claims priority under 35 U.S.C. §119(a) to an earlier Korean Application Serial No. 10-2012-0060061, which was filed in the Korean Intellectual Property Office on Jun. 4, 2012, the entire content of which is hereby incorporated by reference.

BACKGROUND

1. Field of the Invention

The present invention relates to an organic light emitting display device and a driving method thereof, and more particularly, to the luminance adjustment in an organic light emitting display device.

2. Description of the Related Art

Among flat panel display devices, an organic light emitting display device displays an image by using organic light emitting diodes (OLEDs) in which emissive electroluminescent layer is a film of organic compound which emits light in response to an electric current using a low power consumption. The layer of organic semiconductor is situated between two electrodes and has excellent light emitting efficiency, luminance, and angle of view.

In general, light emitting display devices are classified into a passive matrix organic light emitting display device (PMOLED) and an active matrix organic light emitting display device (AMODED) according to how organic light emitting diodes are driven.

The passive matrix type corresponds to a method of forming a positive electrode and a negative electrode such that they are perpendicular to each other, then selecting and driving a negative electrode line and a positive electrode line. The active matrix type corresponds to a driving method in which a thin film transistor and a capacitor are integrated in each pixel to maintain a voltage by a capacity of a capacitor. The passive matrix type (PMOLED) has a simple structure and is inexpensive, but is difficult to realize a large-sized or high precision panel. On the other hand, the active matrix type (AMOLED) can realize a large-sized and high precision panel, but a control method thereof is technically difficult and expensive. In the aspects of resolution, contrast, and operating speed, the active matrix organic light emitting display devices (AMOLEDs) which select and switch on unit pixels are mainly used.

Meanwhile, factors for improving display quality of an organic light emitting display device may include gamma setting. The gamma setting is a correlation between display luminance and grayscale data, which is defined according to a gamma curve. A very accurate gamma setting is necessary for the organic light emitting display device to maintain a stable display quality. Gamma setting errors are occasionally generated by various factors such as dispersion of components, a cell gap of a liquid crystal panel, a change in thickness of a color filter, and a driving voltage in an actual organic light emitting display device. If an error is generated in the gamma setting, a deviation is generated between the actual display luminance and the display luminance due to the grayscale data. In order to minimize the deviation, multi time programming (MTP) which programs a reference gamma voltage in real time is performed. A reference gamma voltage is a voltage input to a driving circuit which generates a data signal for determining display luminance. According to the grayscale data, the driving circuit generates a data signal by using a reference gamma voltage, and the light emitting elements emit light in response to the data signal. Thus, if the reference gamma voltage is changed, the display luminance of the organic light emitting display device is also changed.

SUMMARY OF THE INVENTION

An aspect of the present invention is to provide an organic light emitting display device and a driving method thereof by which luminance can be enhanced and optical characteristics such as transmission of light through display can be improved.

Another aspect of the present invention is to provide an organic light emitting display device and a driving method thereof by which a transverse and longitudinal mura defect or irregular luminosity variation defects of a panel due to process flaws, for example, caused by a lack of driving currents of the panel can be prevented.

In accordance with an aspect of the present invention, a driving method of an organic light emitting display device includes: classifying a plurality of luminance steps into at least one low luminance section and a high luminance section; and setting a reference luminance at a predefined level during the low luminance section and adjusting an off duty according to predetermined criteria for each step in the low luminance section.

The high ranking luminance section distinguished from the low luminance section may be also set to a high luminance section and a middle luminance section, so that a preset off duty ratio is set in the middle luminance section and each step in the middle luminance step is adjusted differently.

In accordance with another aspect of the present invention, an organic light emitting display device includes: a display unit having a plurality of pixels are arranged in the form of a matrix, wherein the pixels have organic light emitting diodes emitting light corresponding to a flow of a driving current received thereon; and a driving unit which classifies a plurality of luminance steps into at least a low luminance section and a high luminance section; and sets a reference luminance at a predefined level during the low luminance section, and adjusting an off duty according to predetermined criteria for each step in the low luminance step.

BRIEF DESCRIPTION OF THE DRAWINGS

The above and other aspects, features, and advantages of the present invention will be more apparent from the following detailed description taken in conjunction with the accompanying drawings, in which:

FIG. 7A, FIG. 7B and FIG. 8 are views showing an entire driving method of the display device according to the embodiment of the present invention.

DETAILED DESCRIPTION

Hereinafter, various embodiments of the present invention will be described in detail with reference to the accompanying drawings. In the following description, specific items such as detailed elements are illustrated, but it is obvious to those skilled in the art that such items are provided only to help with a more general understanding of the present invention and may be modified and changed without departing from the scope of the present invention.

Figure 1:
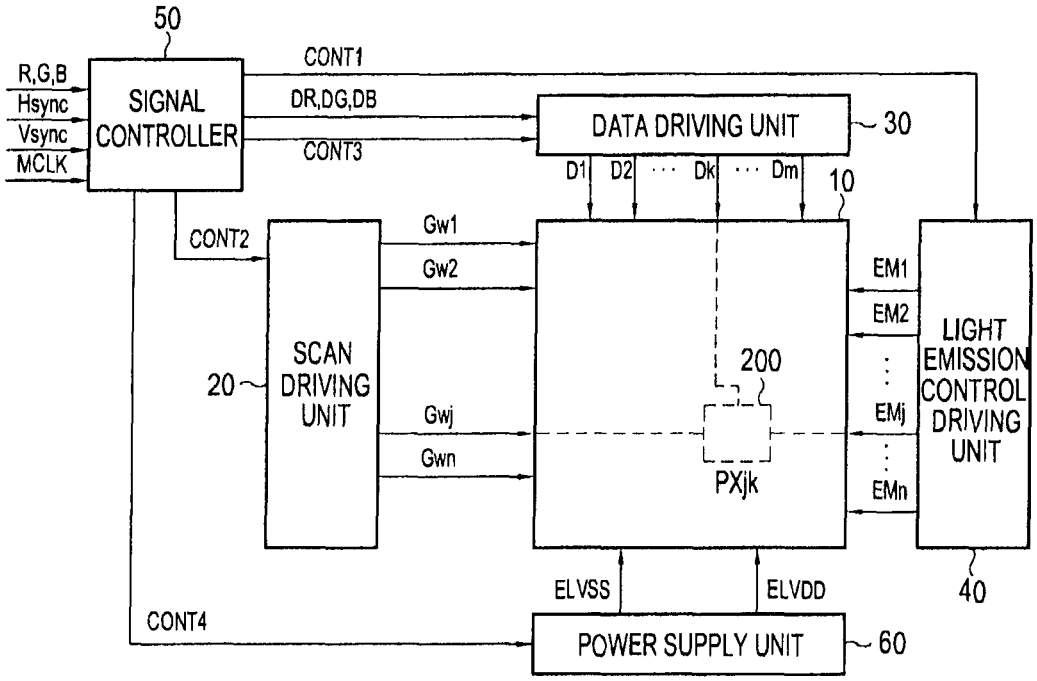
FIG. 1 is a block diagram showing a structure of a display device according to an embodiment of the present invention.

FIG. 1 is a block diagram showing a structure of a display device according to an embodiment of the present invention.

As shown, display device 1 according to the embodiment of the present invention includes a display unit 10 including a plurality of pixels, a scan driving unit 20 for transmitting a plurality of scan signals to the display unit 10, a data driving unit 30 for transmitting a plurality of data signals to the display unit 10, a light emission control driving unit 40 for transmitting a plurality of light emission control signals to the display unit 10, a power supply unit 60 for supplying driving power to the display unit 10, and a signal controller 50 including the scan driving unit 20, for supplying a plurality of control signals for controlling signals generated by the data driving unit 30 and the light emission control driving unit 40 to be transmitted.

The display unit 10 is a panel where a plurality of pixels are arranged in the form of a matrix, and each of the pixels 200 includes an organic light emitting diode (not shown) emitting light corresponding to a flow of a driving current in response to a data signal transmitted from the data driving unit 30. A plurality of scan lines Gw1 to Gwn formed in a column direction to transmit scan signals and a plurality of data lines D1 to Dm formed in a row direction to transmit data signals are arranged in the plurality of pixels included in the display unit 10. A plurality of light emission control lines EM1 to EMn formed in a column direction to transmit light emission control signals are further arranged in the plurality of pixels.

That is, a pixel PXjk 200 located in a j-th pixel column and a k-th pixel column of the plurality of pixels is connected to one scan line Gwj, one data line Dk, and one light emission control line EMj corresponding thereto. However, this is merely an illustrative embodiment, and the present invention is not necessarily limited to the above configuration and structure and may be variously modified.

The pixels 200 supply a current to organic light emitting diodes in response to a corresponding data signal, and the organic light emitting diodes emit light of a predetermined luminance in response to the supplied current. A first power voltage ELVDD and a second power voltage ELVSS necessary for an operation of the display unit 10 are transmitted from the power supply unit 60.

The scan driving unit 20 is a unit for applying a plurality of scan signals to the display unit 10, and is connected to the plurality of scan lines Gw1 to Gwn to transmit the plurality of scan signals to corresponding scan lines of the plurality of scan lines. The scan driving unit 20 generates scan signals to the scan lines connected to the plurality of pixel columns included in the display unit 10, respectively, according to a scan drive control signal CONT2 supplied from the signal controller 50 to transmit the scan signals.

The data driving unit 30 generates a plurality of data signals from image data signals DR, DG, and DB transmitted from the signal control unit 50, and transmits the plurality of data signals to the plurality of data lines D1 to Dm connected to the display unit 10. The driving of the data driving unit 30 is operated by a data drive control signal CONT3 supplied from the signal control unit 50. As will be described later, the data driving unit 30 additionally performs a luminance adjusting operation according to predetermined criteria in accordance with the teachings of the present invention.

The light emission control driving unit 40 generates a plurality of light emission control signals and transmits the plurality of light emission control signals to the plurality of light emission control lines EM1 to EMn connected to the display unit 10 in response to a light emission control driving unit control signal CONT1 supplied from the single controller 50. As will be described later, the light emission control driving unit 40 additionally performs an operation for adjusting a luminance according to the teachings of the present invention.

In an alternate embodiment, the scan driving unit 20, the data driving unit 30, and the light emission control driving unit 40 may be implemented by one drive unit, for example, an AMOLED driver IC (DDI) in hardware.

The plurality of pixels included in the display unit 10 receives a corresponding light emission control signal, and accordingly, enables the organic light emitting diodes emit light with data voltages corresponding to the data signals to display the emission of light.

Figure 2:
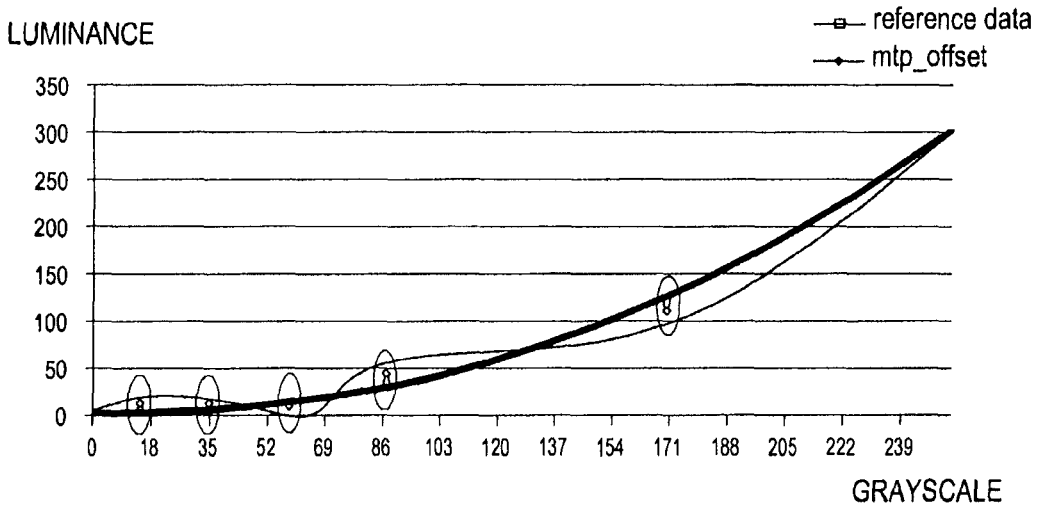
FIG. 2, FIG. 3A and FIG. 3B are views for explaining a smart dimming method of driving methods of the display device according to the embodiment of the present invention.

Referring to FIG. 2, the display device having the above-described configuration performs a luminance (brightness) step implementation algorithm called 'smart dimming' to improve the dispersion of optical characteristics (grayscale linearity, color temperature, and chrominance) for luminance (brightness) steps, as explained hereinafter. Briefly, in operation, a low-ranking luminance step is set by using an equation by a 2.2 gamma graph for luminance for grayscale at a maximum luminance reference (300 cd/m$^2$). Then, the luminance (brightness) step is classified and set in units of about 10 cd/m$^2$.

More specifically, in the smart dimming method, first, 300 cd/m$^2$ gamma register values suitable for central cell gamma characteristics are changed to 300 cd/m$^2$ gamma-compensated MTP register values for cells. Then, a lookup table representing a correlation between luminance for grayscale and RGB voltages at 300 cd/m$^2$ is created. Thereafter, in the in-use environment, for example, when a change (adjustment) of brightness to 100 cd/m$^2$ is requested, an RGB voltage value is changed to an RGB register value at 100 cd/m$^2$ by searching for an RGB voltage value according to a luminance for grayscale at 100 cd/m$^2$ from the look up table thus making it possible to apply a gamma calculated at 100 cd/m$^2$ corresponding to the RGB register value. Briefly, the smart dimming method according to the present invention provides calculating a luminance with an ideal value of a preset gamma reference due to the characteristics of an AMOLED driver IC (DDI), then the gamma reference is adjusted while the off duty is also altered during two specific period which in turn provides and maintains a stable display quality, as shown in FIG. 3. A detailed explanation of this process is explained later with reference to FIG. 7.

Figure 3A:
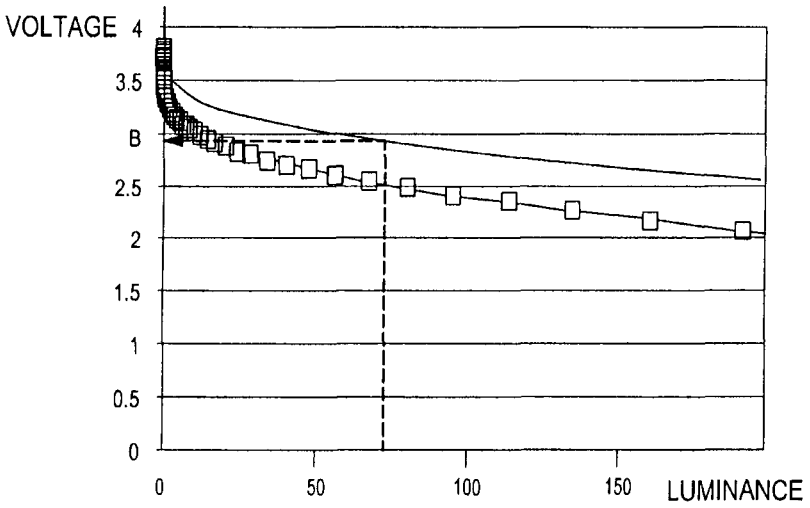
Figure 3B:
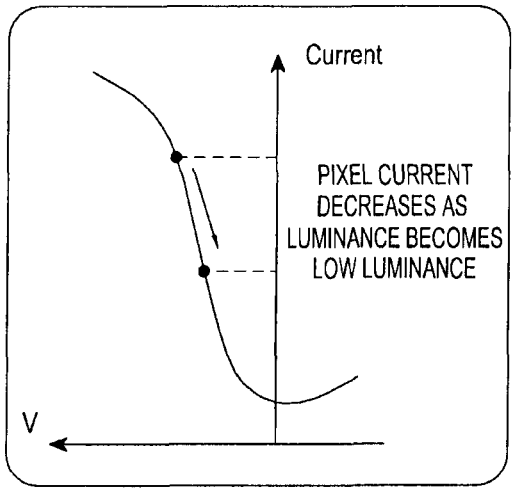
Figure 4:
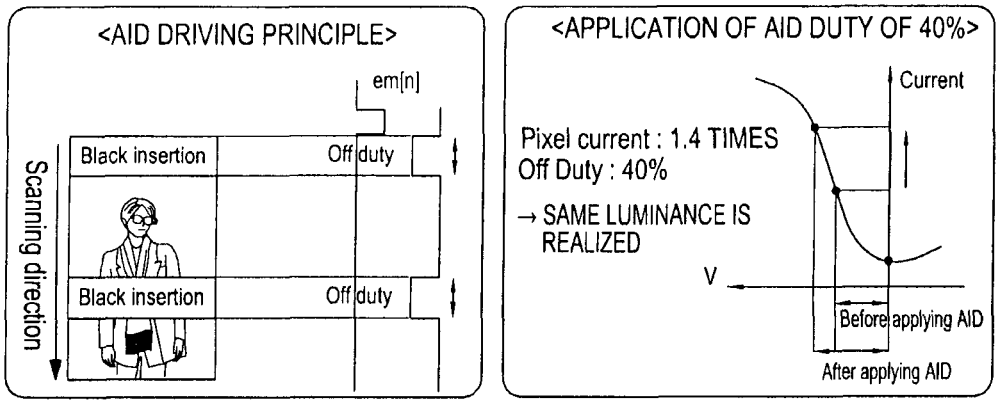
FIG. 4, FIG. 5 and FIG. 6 are views for explaining an AID driving method of driving methods of the display device according to the embodiment of the present invention.

In a description of a voltage/luminance calculation method in the smart dimming, as shown in FIGS. 3A and 3B, a voltage for a given luminance in a table calculated in advance by using a voltage location formula with respect to 255 grayscale points based on RGB (8/8/8 bits) is obtained.

To aid in understanding of the invention, FIG. 3A shows an example of a voltage value corresponding to a luminance value at an arbitrary specific point. FIG. 3B shows a relationship of currents for driving voltages of a gate terminal when a pixel driving transistor is, for example, a PMOS transistor, and it can be seen that a pixel current is reduced when a low luminance is realized.

However, although the smart dimming method according to the teachings of the present invention has the optical characteristics of a 300 cd/m$^2$ luminance step, a mure defect may be generated by a deviation of a pixel current due to a low current for pixel driving at a low luminance/low grayscale, and a dispersion of the optical characteristics, such as color difference (MPCD: Minimum Perceptual Color Difference), color temperature, and grayscale linearity, may increase. Due to the problem associated with the increased dispersion of the optical characteristics at a low luminance, a expressible minimum luminance should be limited to 40 cd/m$^2$. If the minimum luminance set to lower than 40 cd/m$^2$, the optical characteristics deteriorates.

In order to overcome the above problem, a measure of applying a so called AMOLED impulsive driving (AID) function to apply the current differently during two specific dimming sections for luminance steps in accordance with the present invention. That is, an optimum brightness is realized by classifying or dividing dimming sections into three sections of high luminance/middle luminance/low luminance.

Figure 5:
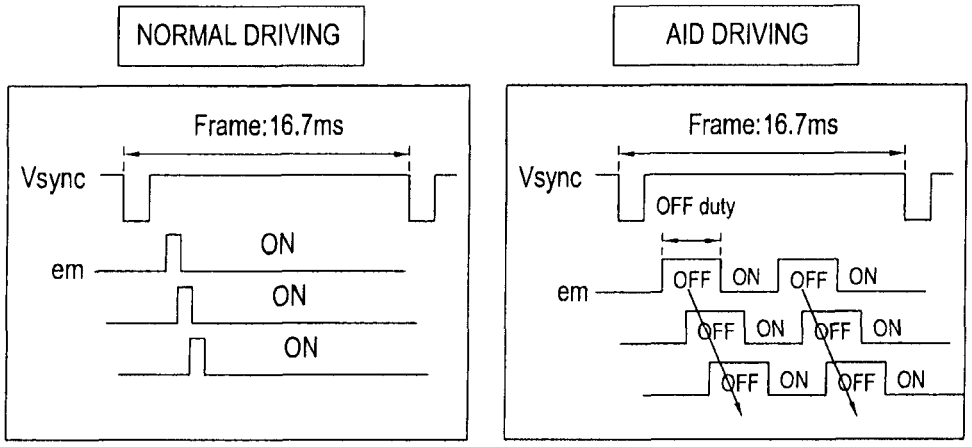
Figure 6:
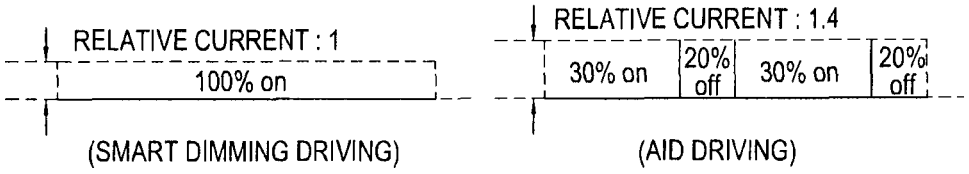

More particularly, as shown in FIGS. 4 to 7, the AID dimming according to the present invention is adapted to increase an amount of currents in a unit pixel in a light emitting section and address a mure by applying a higher amount of currents during certain sections (i.e., AID fixing section and AID diming section) and adjusting the duty ratio according to predefined criteria during these two period of sections. FIG. 5 shows a 'normal driving mode' which correspond to the 'smart dimming section' in FIG. 7A. Note that the luminance step column in FIG. 7A illustrates the conventional method, whereas the referenced luminance column and the duty ratio column illustrate different current voltage and off duty ratio applied at the AID fixing section and the AID dimming section according to the teachings of the present invention. As shown in FIG. 5 and FIG. 6, during the AID driving mode, the off duty is turned on and off according to the specified ratio. For example, during the AID fixing section, the reference luminance is set 273 cd/m$^2$ when the conventional method is set at 180 cd/m$^2$, but introduces off duty at 40% in accordance with the present invention to yield an equivalent 180 cd/m$^2$ step as in the conventional method.

That is, it can be seen from the drawings that can be seen from the drawings that the inventive method does not set luminance to correspond to luminance (brightness) during a preset middle luminance section as in the conventional art, but sets the off duty ratio at a specific ratio while increasing the current amount to yield an optimal reference luminance. For example, when luminance (brightness) steps correspond to 180 cd/m$^2$, 170 cd/m$^2$, 160 cd/m$^2$, . . . , 120 cd/m$^2$ in the middle luminance section, the reference luminance in the luminance (brightness) steps may be set to a luminance (brightness) step of 273 cd/m$^2$, 258 cd/m$^2$, 244 cd/m$^2$, 229 cd/m$^2$ . . . , 186 cd/m$^2$, the off duties are set, for example.

Further, it can be seen from the drawings that the inventive method does not set luminance to correspond to luminance (brightness) during a preset low luminance section, but sets the off duty ratio variably in order to increase the current amount to correspond to an optimal reference luminance, so that the optical characteristics are not lowered. For example, when luminance (brightness) steps correspond to 100 cd/m$^2$, 90 cd/m$^2$, 80 cd/m$^2$, 20 cd/m$^2$ in the low luminance section, the reference luminance in the luminance (brightness) steps may be set to a luminance (brightness) step of 110 cd/m$^2$. In addition, off duties are set, for example, to 11.1%, 20.0%, 30.9%, . . . , 84.0% in the luminance (brightness) steps of 100 cd/m$^2$, 90 cd/m$^2$, . . . , 20 cd/m$^2$ so that proper luminance is shown in the corresponding luminance (brightness) steps. Note that the duty ratio applied during the low luminance section is obtained from an experimentation to yield an optical characteristics.

In more detail, the AID dimming is applied to a defect area of a low luminance/low grayscale by classifying three different luminance (brightness) steps in which the smart dimming is applied to the high luminance region as in the conventional method. For example, as shown in detail in FIG. 6, since a sum of "relative current 1 & off duty 0%" for one frame in the smart dimming section corresponds to a sum of "relative current 1.4 & off duty 40%", the increased current and off duty in the AID fixing section.

Meanwhile, since the AID dimming driving during the fixing and dimming sections uses a principle of increasing currents of pixels and varying currents of pixels by adjusting a duty ratio with reference to a specific luminance (brightness), power consumption may be increased if the same AID driving principle is applied in the high luminance region. Thus, the conventional smart dimming is applied in a high luminance region in the same way, and the AID driving according to the teachings of the present invention is only applied in a middle luminance/low luminance region.

Figure 7B:
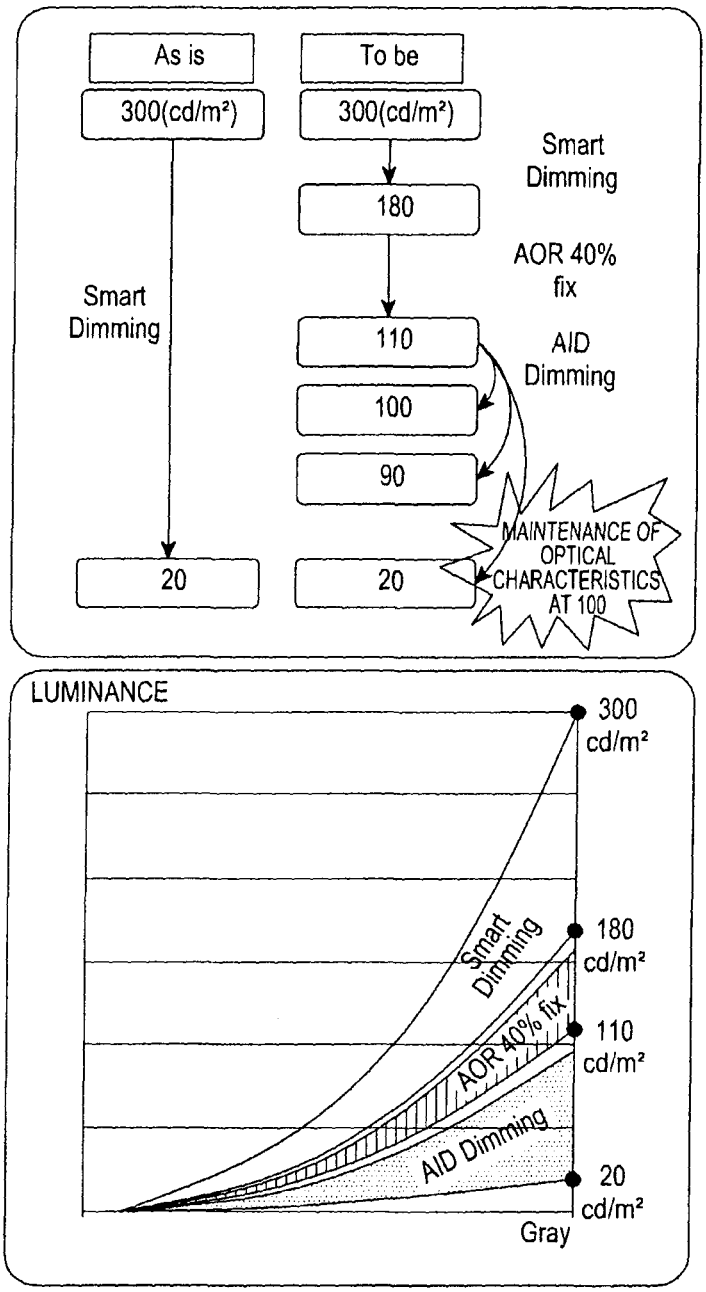

Referring to FIGS. 7A and 7B, in the embodiment of the present invention, the sections are classified into a smart dimming section which is a high luminance section relative to a maximum luminance of 300 cd/m$^2$, a middle luminance section, for example, an AID fixing section in which an AMOLED off ratio (AOR) is fixed to 40%, and an AID dimming applied section which is a low luminance section in which the AMOLED off ratio (AOR) is set variably as shown in FIG. 7A.

The smart dimming section is a section in which the luminance (brightness) step corresponds to 300 cd/m$^2$ to 190 cd/m$^2$, and for example, the luminance brightness step is classified in units of 10 cd/m$^2$ so that the smart dimming driving can be performed at a reference luminance corresponding to the corresponding luminance brightness step.

Figure 8:
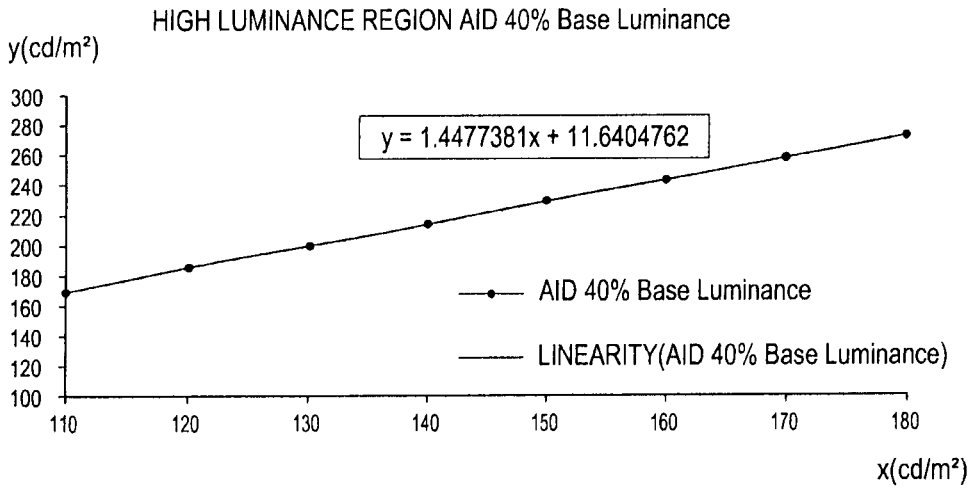

The AID fixing section in which the AOR is fixed to 40% is, for example, a section corresponding to a section in which the luminance step (brightness) step corresponds to 180 to 110 cd/m$^2$, and the luminance brightness steps are classified in units of 10 cd/m$^2$. However, since the AOR is fixed to 40%, the reference luminance is set to 273 cd/m$^2$, for example, when the luminance (brightness) step corresponds to 180 cd/m$^2$. That is, a reference luminance value for creating 180 cd/m$^2$ should be set to 287 cd/m$^2$ in a 40% off duty state, and may be calculated by an equation of $y=1.4477381x+11.64604762$ as shown in FIG. 8. Here, 'x' is a specific luminance (brightness) step and 'y' is a luminance (brightness) step in a 40% off duty state corresponding to x.

The AID dimming applied section is a section in which, for example, a luminance (brightness) step corresponds to 100 cd/m$^2$ to 20 cd/m$^2$, and the luminance brightness steps may be classified in units of 10 cd/m$^2$. However, in the luminance (brightness) steps, all the reference luminances are set, for example, to 110 cd/m$^2$, and then off duty ratios of the luminance (brightness) steps are adjusted to be higher in low ranking steps.

Luminance sections may be applied as described above, since the AOR 40% fixing section which is a middle luminance section is realized with reference to a luminance (brightness) step having high pixel currents which is a characteristic of the AID driving, for example, the luminance (brightness) step of 180 cd/m$^2$ is realized with reference to the luminance of 287 cd/m$^2$, in which case flickering may be caused by a time delay by which the luminance is reversed and then returns to the original luminance due to the AID driving.

Further, as shown in FIG. 7A, in the exemplary embodiments of the present invention, when the smart dimming section is changed to the AID fixing section, for example at 190 180 cd/m$^2$, the luminance (brightness) step at a border between this transition may be further classified into a plurality of divided luminance (brightness) steps, and so that a section in which a proper reference luminance is set by increasing the off duty ratio from a high ranking step to a low ranking step, for example, from 0% to 40% in the divided steps.

In the present invention, by using the above-described method, although the AID dimming applied section which is a low luminance section is, for example, a section in which the luminance (brightness) step corresponds to 100 to 20 cd/m$^2$, the optical characteristics of 110 cd/m$^2$ can be maintained through variable off duty ratio applied during the low luminance section. In this case, available minimum luminance may be set to 20 cd/m$^2$ or lower than 40 cd/m2.

Figure 9:
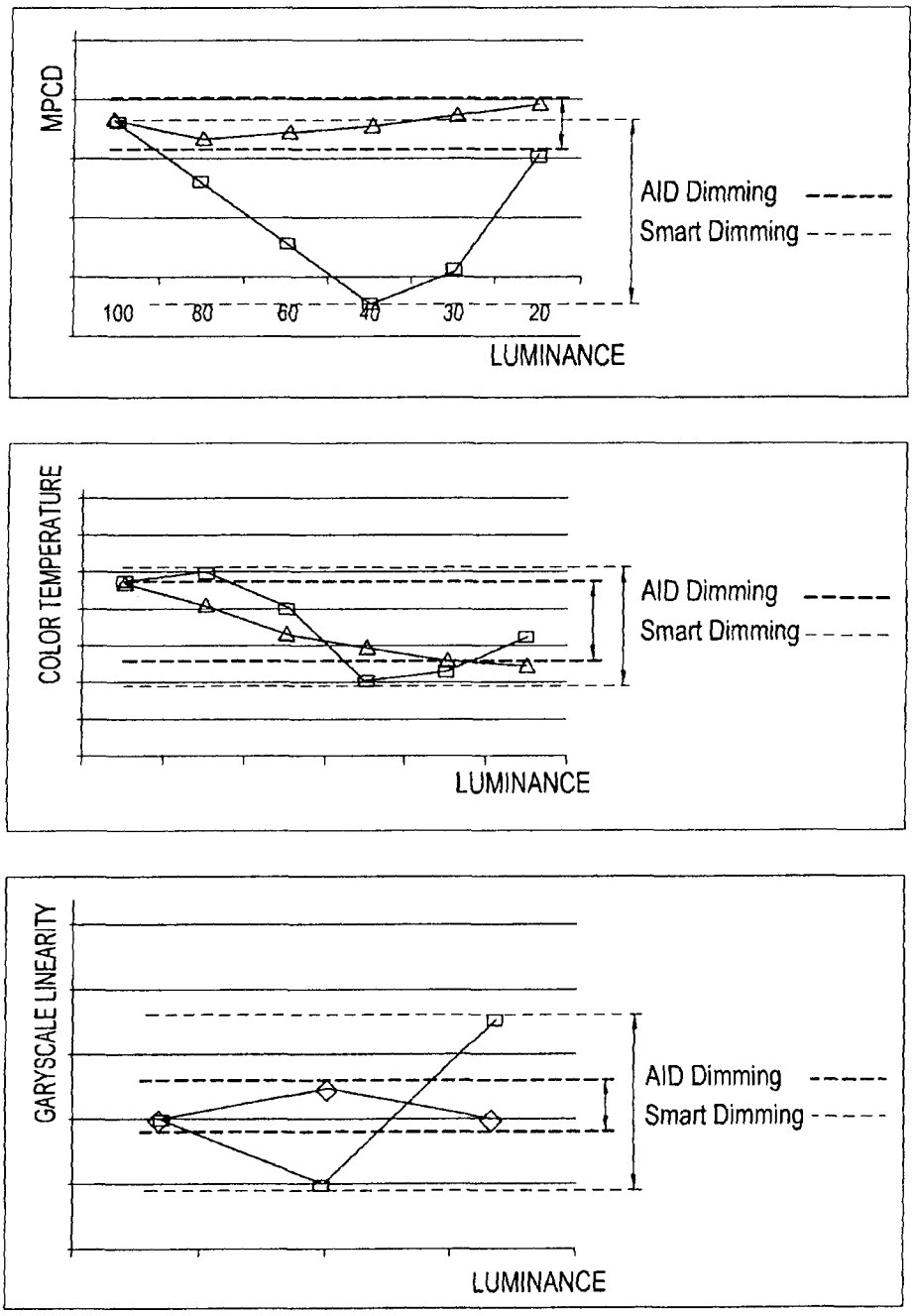
FIG. 9 is a graph depicting optical characteristics of the driving method of the display device according to the embodiment of the present invention.

When the AID dimming method according to the present invention is applied, a mura such as a mure can be improved and the optical characteristics can be improved as compared with the case of using only the smart dimming. It can be seen from FIG. 9 that the low luminance mure defect is improved by about 5% and the optical characteristics can be improved in the aspects of dispersion MPCD, color temperature, and grayscale linearity.

As described above, the organic light emitting display device and the driving method thereof according to the present invention can improve luminance and optical characteristics, and in particular, even in the case of low luminance/low grayscale driving, a transverse and longitudinal mura detect of a panel due to a lack of a driving current of the panel can be prevented.

The configuration and operation according to the embodiment of the present invention can be achieved as described above, and although a detailed embodiment has been described in the description of the present invention, various modifications can be made without departing from the scope of the present invention.

For example, although it has been described that the sections are classified into three sections of high luminance, middle luminance, and low luminance sections, only the low luminance section can be set to the AID dimming section and the smart dimming can be applied to the remaining sections.

Further, although it has been described that the AOR is fixed to 40% in the middle luminance section, the AOR can be fixed to another ratio such as 30% when being realized. Of course, in this case, the relative current can be properly set, for example, not to 1.4 times but to 1.3 times.

In addition, although it has been proposed in the above description that the luminance (brightness) steps are classified into three sections of high luminance, middle luminance, and low luminance sections, it is a simple example and other luminance (brightness) steps can be properly selected in another embodiment.

In this way, the present invention can be variously modified and changed, and thus the scope of the present invention shall be determined not by the above-described embodiment but by the claims and their equivalents.

The above-described methods according to the present invention can be implemented in hardware, firmware or via the execution of software or computer code that can be stored in a recording medium such as a CD ROM, an RAM, a floppy disk, a hard disk, or a magneto-optical disk or computer code downloaded over a network originally stored on a remote recording medium or a non-transitory machine readable medium and to be stored on a local recording medium, so that the methods described herein can be rendered in such software that is stored on the recording medium using a general purpose computer, or a special processor or in programmable or dedicated hardware, such as an ASIC or FPGA. As would be understood in the art, the computer, the processor, microprocessor controller or the programmable hardware include memory components, e.g., RAM, ROM, Flash, etc. that may store or receive software or computer code that when accessed and executed by the computer, processor or hardware implement the processing methods described herein. In addition, it would be recognized that when a general purpose computer accesses code for implementing the processing shown herein, the execution of the code transforms the general purpose computer into a special purpose computer for executing the processing shown herein.

While the present invention has been particularly shown and described with reference to exemplary embodiments thereof, it will be understood by those skilled in the art that various changes in form and details may be made therein without departing from the spirit and scope of the present invention as defined by the appended claims.

What is claimed is:

1. An organic light emitting display device including a range of brightness of the display device divided into at least a high brightness section and a low brightness section, each section has a plurality of brightness steps, and receiving a user request for adjusting of the brightness of the display device, comprising:

a display unit having a plurality of pixels are arranged in the form of a matrix, wherein the pixels have organic light emitting diodes for emitting light corresponding to a flow of a driving current received thereon; and a driving unit which sets at least one of an off duty and a reference luminance and drives the display unit according to the user request for adjusting of the brightness of the display device, wherein the driving unit maintains a same reference luminance and adjusts preset amount of off duty when the brightness of the display device is adjusted in the low brightness section according to the user request, and the driving unit maintains a same off duty and adjusts preset amount of reference luminance when the brightness of the display device is adjusted in the high brightness section according to the user request.

2. The organic light emitting display device of claim 1, wherein the range of brightness has a middle brightness that falls between the high brightness section and the low brightness section so that a preset same off duty ratio is set for each step in the middle brightness section, and a reference luminance of each step in the middle brightness section is adjusted differently.

3. The organic light emitting display device of claim 2, wherein the preset off duty ratio is 40% in the middle brightness section.

4. The organic light emitting display device of claim 2, wherein a brightness step between the high brightness section and the middle brightness section into a plurality of divided brightness steps, and each of the divided brightness steps is set by increasing the off duty ratio from a high ranking step to a low ranking step.

5. The organic light emitting display device of claim 2, wherein the driving unit sets the high brightness section, the middle brightness section, and the low brightness section to sections in which brightness steps include 300 cd/m$^2$ to 200 cd/m$^2$, 180 cd/m$^2$ to 120 cd/m$^2$, and 100 cd/m$^2$ to 20 cd/m$^2$, respectively.

6. A driving method of an organic light emitting display device including a range of brightness of the display device divided into at least a high brightness section and a low brightness section, each section has a plurality of brightness steps, comprising:

setting a reference luminance at a predefined level;

receiving a user request for adjusting of the brightness of the display device;

setting at least one of an off duty and a reference luminance in response to the user request for adjusting of the brightness of the display device; and driving the display device according to the setting;

wherein the setting comprises, maintaining a same reference luminance and adjusting preset amount of off duty when the brightness of the display device is adjusted in the low brightness section according to the user request, and maintaining a same off duty and adjusting preset amount of reference luminance when the brightness of the display device is adjusted in the high brightness section according to the user request.

7. The driving method of claim 6, wherein the range of brightness has a middle brightness section that falls between the high brightness section and the low brightness section so that a preset same off duty ratio is set for each step in the middle brightness section and a reference luminance of each step in the middle brightness section is adjusted differently.

8. The driving method of claim 7, wherein the preset off duty ratio is 40% in the middle brightness section.

9. The driving method of claim 7, wherein the low brightness section is defined by using an equation by a 2.2 gamma graph for grayscale luminance as a maximum reference luminance in the high brightness section.

10. The driving method of claim 7, wherein a brightness step between the high brightness section and the middle brightness section is further classified into a plurality of divided brightness steps, and each of the divided brightness steps is set by increasing the off duty ratio from a high ranking step to a low ranking step.

11. The driving method of claim 7, wherein the high brightness section, the middle brightness section, and the low brightness section are set as sections in which brightness steps include 300 cd/m$^2$ to 200 cd/m$^2$, 180 cd/m$^2$ to 120 cd/m$^2$, and 100 cd/m$^2$ to 20 cd/m$^2$, respectively.

* * * * *